US010823537B2

(12) United States Patent
Jones

(10) Patent No.: US 10,823,537 B2
(45) Date of Patent: Nov. 3, 2020

(54) EXPANDABLE BROADHEAD

(71) Applicant: H.I.T. OUTDOORS, LLC, Clay City, KY (US)

(72) Inventor: Brian K. Jones, Clay City, KY (US)

(73) Assignee: H.I.T. OUTDOORS, LLC, Clay City, KY (US)

( * ) Notice: Subject to any disclaimer, the term of this patent is extended or adjusted under 35 U.S.C. 154(b) by 0 days.

(21) Appl. No.: 16/239,630

(22) Filed: Jan. 4, 2019

(65) Prior Publication Data

US 2020/0217631 A1 Jul. 9, 2020

(51) Int. Cl.
*F42B 6/08* (2006.01)
*F42B 12/34* (2006.01)

(52) U.S. Cl.
CPC ..... *F42B 6/08* (2013.01); *F42B 12/34* (2013.01)

(58) Field of Classification Search
CPC ..... F42B 6/08; F42B 12/34
USPC ..... 473/578, 583
See application file for complete search history.

(56) References Cited

U.S. PATENT DOCUMENTS 4,099,720 A * 7/1978 Zeren ..... F42B 6/08 473/584
4,210,330 A 7/1980 Kosbab
4,932,671 A * 6/1990 Anderson, Jr. ..... F42B 6/08 473/583
5,172,916 A * 12/1992 Puckett ..... F42B 6/08 473/583
5,322,297 A * 6/1994 Smith ..... F42B 6/08 473/583
5,458,341 A * 10/1995 Forrest ..... F42B 6/08 473/583
5,564,713 A * 10/1996 Mizek ..... F42B 6/08 473/583
5,820,498 A * 10/1998 Maleski ..... F42B 6/08 473/584
5,857,930 A * 1/1999 Troncoso ..... F42B 6/08 473/583
5,879,252 A * 3/1999 Johnson ..... F42B 6/08 473/583
6,171,206 B1 * 1/2001 Liechty, II ..... F42B 6/08 473/583
6,287,223 B1 * 9/2001 Liechty, II ..... F42B 6/08 473/583
6,287,224 B1 * 9/2001 Liechty, II ..... F42B 6/08 473/583
6,322,464 B1 * 11/2001 Sestak ..... F42B 6/08 473/583
6,517,454 B2 * 2/2003 Barrie ..... F42B 6/08 473/583
6,595,881 B1 * 7/2003 Grace, Jr. ..... B22F 3/22 473/583

(Continued)

*Primary Examiner* — Alexander R Niconovich
(74) *Attorney, Agent, or Firm* — Price Heneveld LLP

(57) ABSTRACT

The present invention provides an expandable broadhead in which the inner surface of the blades contacts a band on the ferrule. The ferrule includes forward blade stops to securely align the blades in a closed position. The ferrule also includes rearward blade stops to securely align the blades in a fully deployed position. The blades can easily rotate to the fully deployed position when the broadhead contacts and penetrates a target. The kinetic energy used to deploy the blades is reduced given the angle of the blades and the angle of rotation of the blades.

20 Claims, 7 Drawing Sheets

(56) References Cited

U.S. PATENT DOCUMENTS

| | | | | |
|---|---|---|---|---|
| 6,758,774 | B2 * | 7/2004 | Liechty, II | F42B 6/08 473/584 |
| 6,793,596 | B1 * | 9/2004 | Sullivan | F42B 6/08 473/583 |
| 6,830,523 | B1 * | 12/2004 | Kuhn | F42B 6/08 473/583 |
| 6,935,976 | B1 * | 8/2005 | Grace, Jr. | F42B 6/08 473/583 |
| 7,377,869 | B2 * | 5/2008 | Wohlfeil | F42B 6/08 473/583 |
| 8,062,155 | B2 * | 11/2011 | Butcher | F42B 6/08 473/582 |
| 8,128,521 | B1 * | 3/2012 | Ulmer | F42B 6/08 473/583 |
| 8,272,979 | B1 * | 9/2012 | Cooper | F42B 6/08 473/583 |
| 8,393,983 | B1 * | 3/2013 | Sanford | F42B 6/08 473/583 |
| 8,628,438 | B1 | 1/2014 | Cooper | |
| 9,170,078 | B2 * | 10/2015 | Pedersen | F42B 6/08 |
| 9,267,773 | B2 * | 2/2016 | Mizek | F42B 6/08 |
| 9,303,963 | B1 * | 4/2016 | Ford | F42B 6/08 |
| 9,372,056 | B2 * | 6/2016 | Sullivan | F42B 6/08 |
| 9,664,484 | B2 * | 5/2017 | Mizek | F42B 6/08 |
| 9,803,962 | B2 * | 10/2017 | Hahn | F42B 6/08 |
| 10,415,940 | B2 * | 9/2019 | Sullivan | F42B 12/34 |
| 2003/0073525 | A1 * | 4/2003 | Liechty, II | F42B 6/08 473/583 |
| 2016/0138897 | A1 * | 5/2016 | Williamson | F42B 6/08 473/583 |
| 2016/0195376 | A1 * | 7/2016 | Rowley | F42B 6/08 473/583 |
| 2017/0191808 | A1 * | 7/2017 | Grace | F42B 6/08 |

* cited by examiner

EXPANDABLE BROADHEAD

BACKGROUND OF THE INVENTION

The present invention relates to broadheads that can be used on an arrow for use with a bow or on a bolt for use with a crossbow. More specifically, the present invention relates to an expanding broadhead that has an inflight closed configuration which, upon striking a target, expands the blades to a deployed position. These types of broadheads are beneficial in that they have flight characteristics somewhat similar to those of a field point tip and penetration characteristics somewhat similar to those of a larger, fixed blade broadhead.

Some types of expanding blade broadheads use blades that are located in slots within the ferrule or blades that slide longitudinally relative to the ferrule. However, substantial kinetic energy is required to rotate or slide the blades into a deployed position, leaving less kinetic energy for target penetration. Moreover, some of these broadheads are less robust, such that the connections of the blades to the ferrule can be damaged upon deployment of the blades or target penetration.

SUMMARY OF THE INVENTION

One aspect of the present invention includes a broadhead with a ferrule having a forward pointed end and a rearward end that couples to a shaft. The ferrule has a plurality of angled threaded posts located between the forward pointed end and the rearward end. A plurality of rearward blade stops are located rearward of the plurality of angled threaded posts. In addition, a plurality of forward blade stops are located forward of the plurality of angled threaded posts. A plurality of blades having a sharpened edge are coupled to the angled threaded posts by fasteners such that each blade has an edge that contacts a forward blade stop when the broadhead is in a closed position, and an edge that contacts a rearward blade stop when the broadhead is in the fully deployed position.

Another aspect of the present invention includes an expandable broadhead that has a ferrule with a forward pointed end and a rearward end. The ferrule includes a plurality of threaded posts located between the forward pointed end and the rearward end. The ferrule also has a plurality of rearward blade stops located rearward of the plurality of threaded posts and a plurality of forward blade stops located forward of the plurality of threaded posts. The ferrule also includes a band slot. The expandable broadhead has a plurality of blades having an inner side facing the ferrule and an outer side facing away from the ferrule, a sharpened edge, and an unsharpened edge. Each blade has a surface that contacts the rearward blade stop when the blade is in the fully deployed position and a fastener opening. A plurality of fasteners are inserted through the fastener openings to couple the plurality of blades to the plurality of threaded posts. A band is inserted into the band slot such that the inner side of the plurality of blades contacts the surface of the band.

In yet a further aspect, the invention includes a broadhead ferrule. The ferrule has a forward portion terminating in a pointed tip, a rearward portion having a rearward most end that couples to a shaft, and a medial portion located between the forward portion and the rearward portion. The ferrule further includes a plurality of angled threaded posts located on the medial portion, a plurality of rearward blade stops located rearward of the threaded posts, and a plurality of forward blade stops located rearward of the pointed tip. The ferrule also includes a band slot located between the plurality of threaded posts and the plurality of forward blade stops.

These and other advantages of the invention will be further understood and appreciated by those skilled in the art by reference to the following written description, claims, and appended drawings.

DETAILED DESCRIPTION OF THE PREFERRED EMBODIMENTS

As referenced in the Figures, the same reference numbers will be used herein to refer to the same parameters and components and similar modifications and alternatives. For purposes of description herein, the terms "upper," "lower," "right," "left," "rear," "front," "vertical," "horizontal," and derivatives thereof shall relate to the present disclosure as oriented in the Figures. However, it is to be understood that the present disclosure may assume various alternative orientations and step sequences, except where expressly specified to the contrary. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise. The drawings referenced herein are schematic and associated views thereof are not necessarily drawn to scale.

Figure 1:
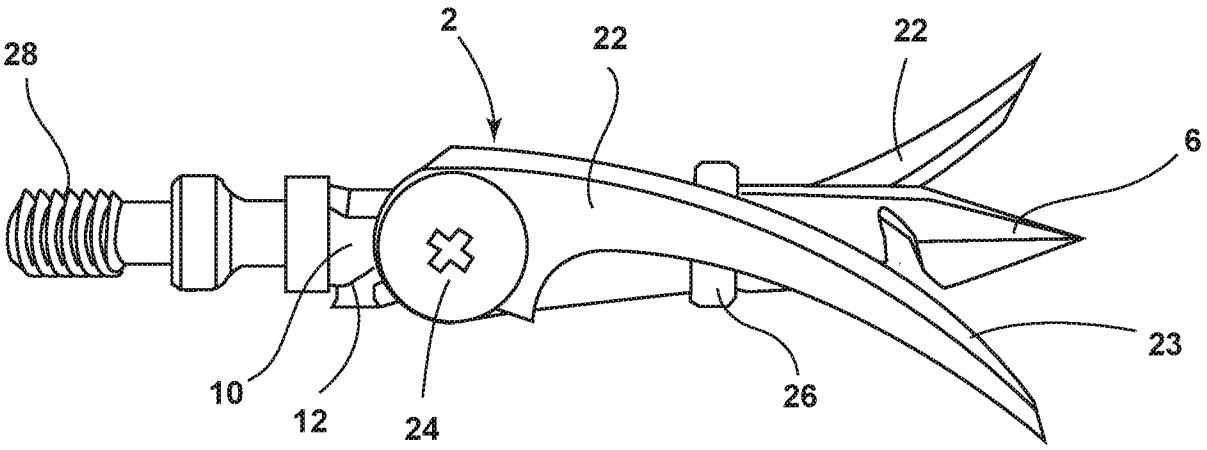
FIG. 1 is a side perspective view of a two-bladed, expandable broadhead according to one embodiment of the present invention.
Figure 2:
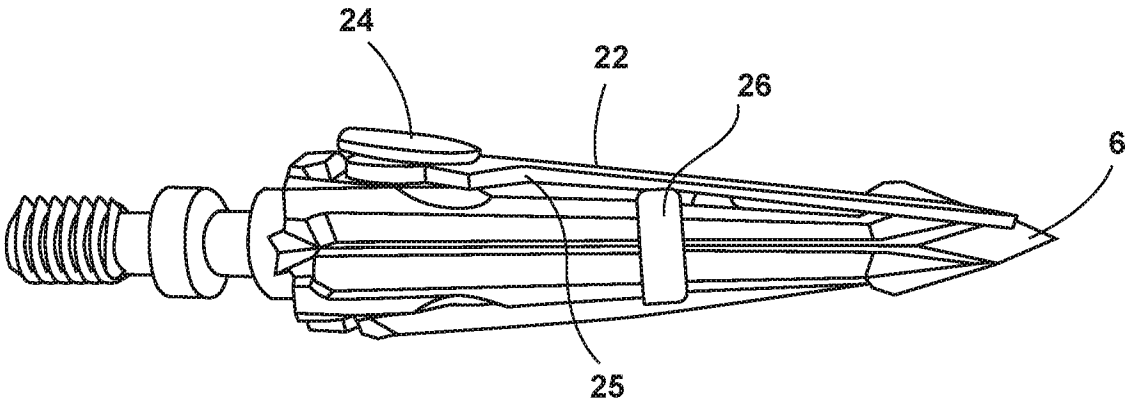
FIG. 2 is a side perspective view of the broadhead of FIG. 1 rotated 90 degrees.
Figure 3:
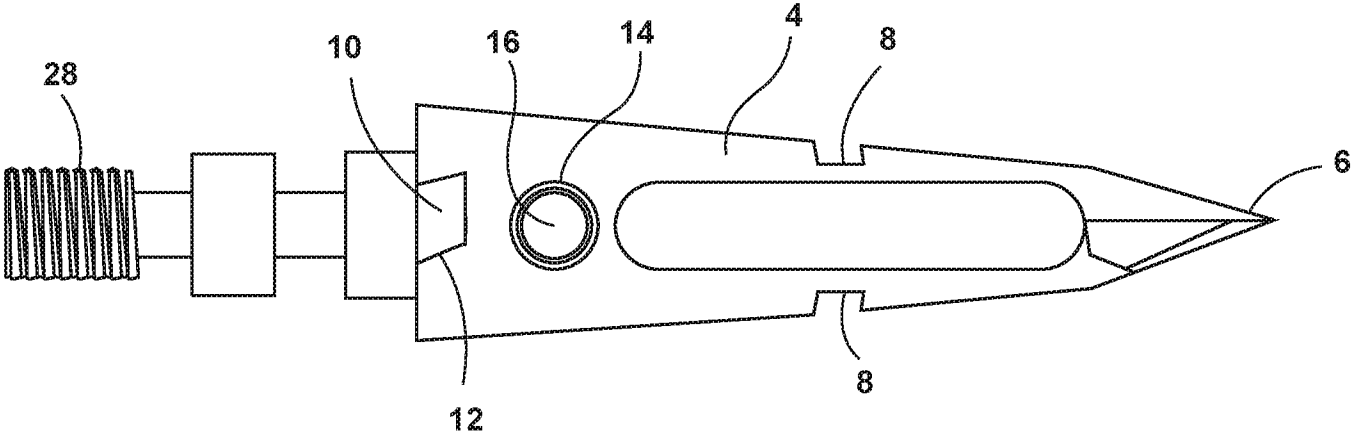
FIG. 3 is a side perspective view of the ferrule of the broadhead shown in FIG. 1.
Figure 4:
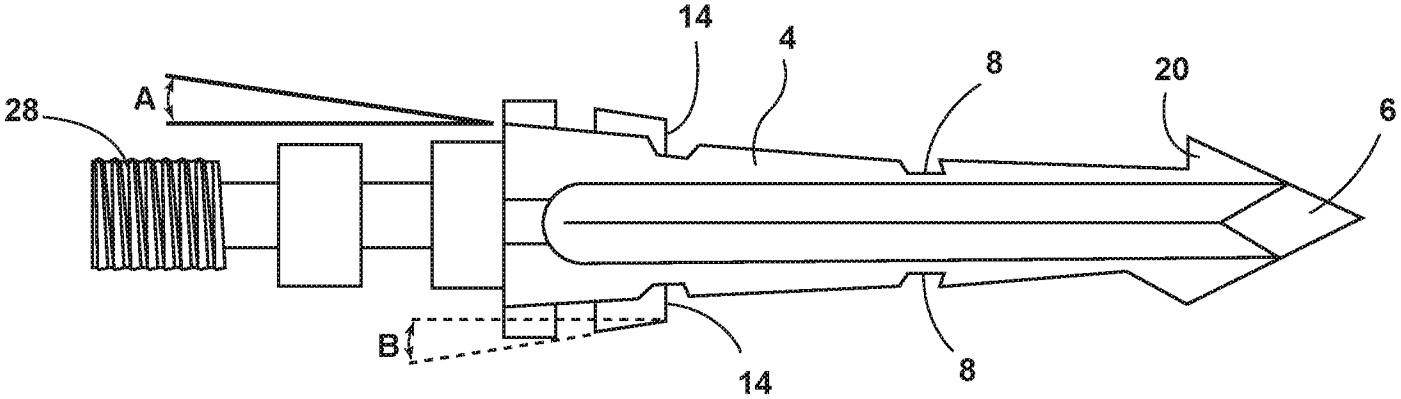
FIG. 4. is a side perspective view of the ferrule shown in FIG. 3 rotated 90 degrees.

As referred to in FIGS. 1-6, an embodiment of an expandable broadhead 2 is shown. The expandable broadhead 2 includes a ferrule 4 that has a forward portion 7 that terminates in tip 6, as illustrated in FIGS. 1-3. The ferrule 4 also includes a rearward portion 9 that terminates with a threaded end 28. The threaded end 28 can connect to a shaft of an arrow for use with a bow, or with the shaft of a bolt for use with a crossbow. The ferrule 4 also includes a medial portion 11 that is located between the forward portion 7 and the rearward portion 9. The ferrule includes posts 14 with an opening 16 that is threaded. The posts 14 are angled, as shown in FIG. 4. The angle B, shown in FIG. 4, can be in the range of 2 to 10 degrees, and more preferably approximately 4 degrees. The posts 14 are drilled and tapped at this approximately 4 degree angle, with the threaded portion being configured to receive a fastener 24. The ferrule 4 also includes forward blade stops 20 and rearward blade stops 10. The rearward blade stops 10 include an angled surface 12. The ferrule 4 also has a band slot 8, as illustrated in FIGS. 3 and 4.

Figure 5:
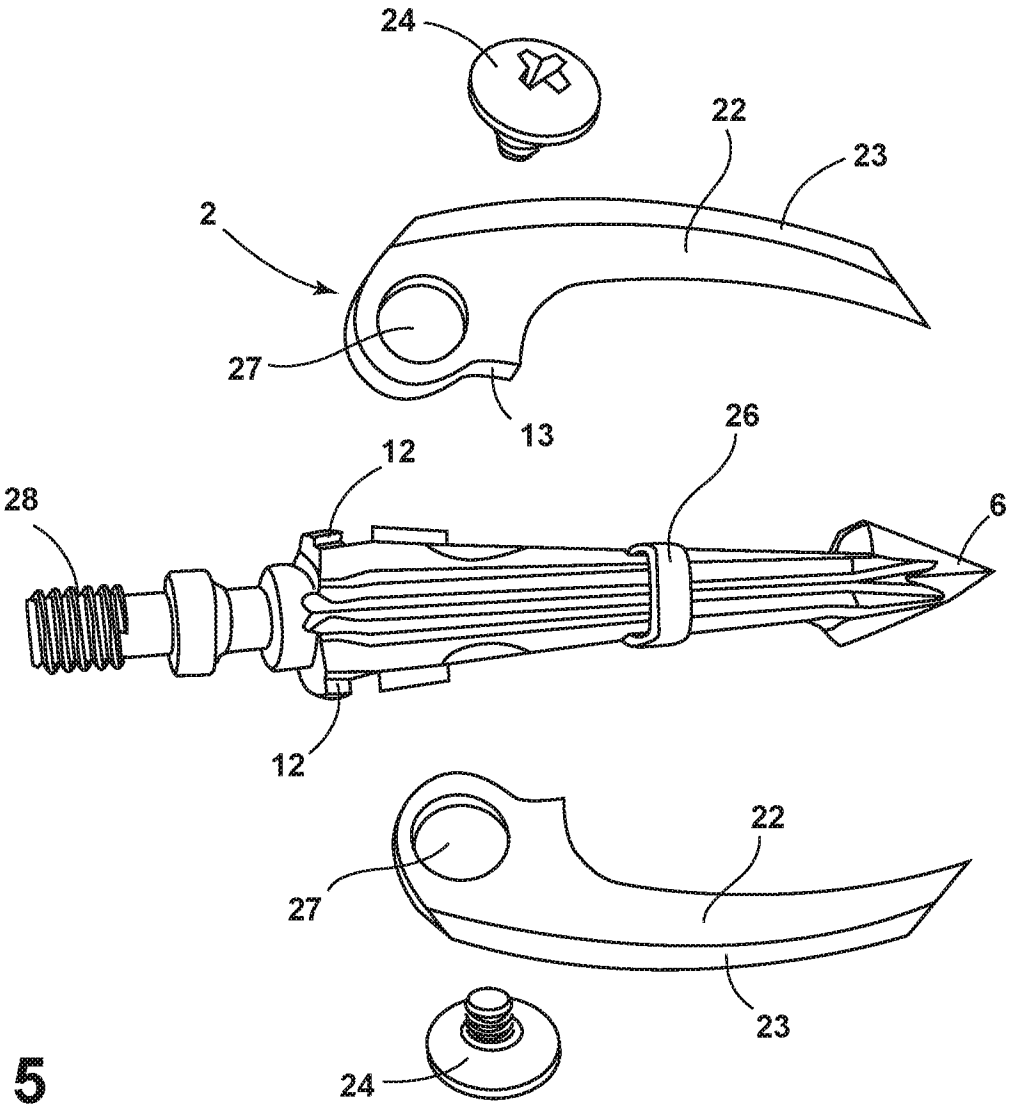
FIG. 5 is an assembly drawing of the components of the broadhead shown in FIGS. 1-2.
Figure 6:
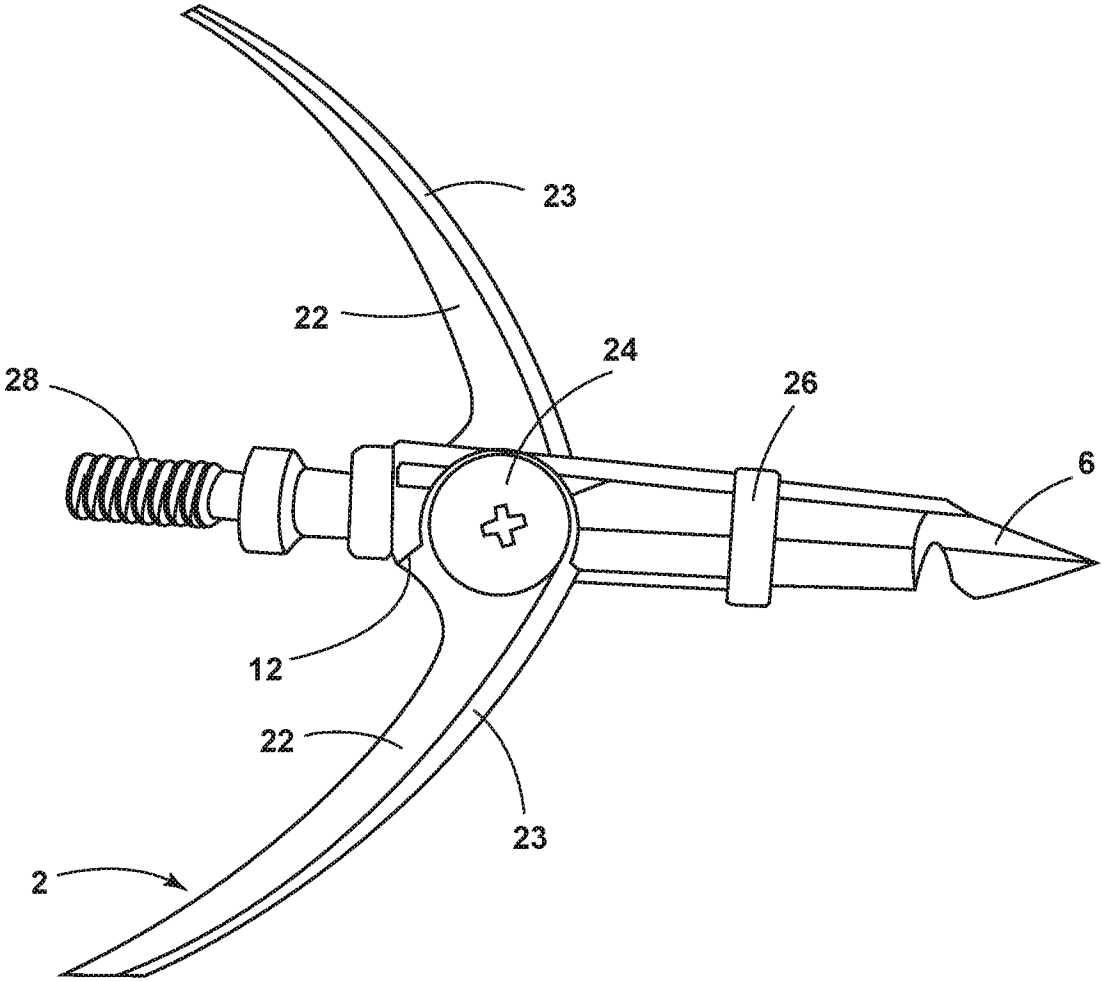
FIG. 6 is a side perspective view of the broadhead shown in FIGS. 1, 2, and 5 with the two blades in a fully deployed position.

As illustrated in FIG. 5, the broadhead 2 includes blades 22. Blades 22 include a sharpened edge 23, an fastener opening 27, and a surface 13 that contacts the angled surface 12 of the rearward blade stop 10 when the blades 22 are in a fully deployed position, as illustrated in FIG. 6. When the blades 22 are in a closed position, a portion of the sharpened edge 23 will contact the forward blade stops 20, as illustrated in FIG. 2. The blades 22 are positioned over a recessed portion 32 of the ferrule 4.

A band 26 is inserted into the band slot 8, as illustrated in FIGS. 1, 2, and 5. The band 26 can be made of any suitable, flexible material to be received in the band slot 8. In the illustrated embodiments, the band 26 is made from a polymeric material such as rubber. As illustrated in FIGS. 1 and 2, the inner surface of the blades 22 will contact the band 26 when the blades 22 are in a closed position. As illustrated in FIG. 6, when the blades 22 are in a fully deployed position, a surface 13 of the blades 22 contacts the angled surface 12 of the rearward blade stops 10, and no portion of the blades 22 is in contact with the band 26. The surface friction of the band 26 contacting the inner surface of the blades 22 keeps the blades 22 in a closed position to prevent accidental deployment and also reduces drag.

The blades 22 are secured to the ferrule 4 by use of fasteners 24 inserted through the fastener openings 27 in the blades 22. In the illustrated embodiment, the fasteners 24 are screws that are received in the threaded portion of posts 14. However, any type of fastener 24 may be used that couples the blades 22 to the posts 14. The arrangement of the blades 22 on the exterior of the ferrule 4 makes the assembly and/or replacement of the blades 22 easier.

As illustrated in the Figures, the angle A of the taper of the ferrule 4 is approximately the same as the angle B of the posts 14 thereby permitting the blades 22 to be on the same general plane as the ferrule 4. The angle B of the posts 14 permits the blades 22 to align such that the inner side of the blades 22 contacts the band 26 when the blades 22 are in a closed position. The forward blade stops 20 keep the tips of the blades 22 in the appropriate closed configuration. As shown in FIG. 1, the blades 22 are angled to easily open upon the broadhead 2 impacting a target as the angle of the blades 22 is preloaded to open to the fully deployed position as illustrated in FIG. 6.

Figure 7:
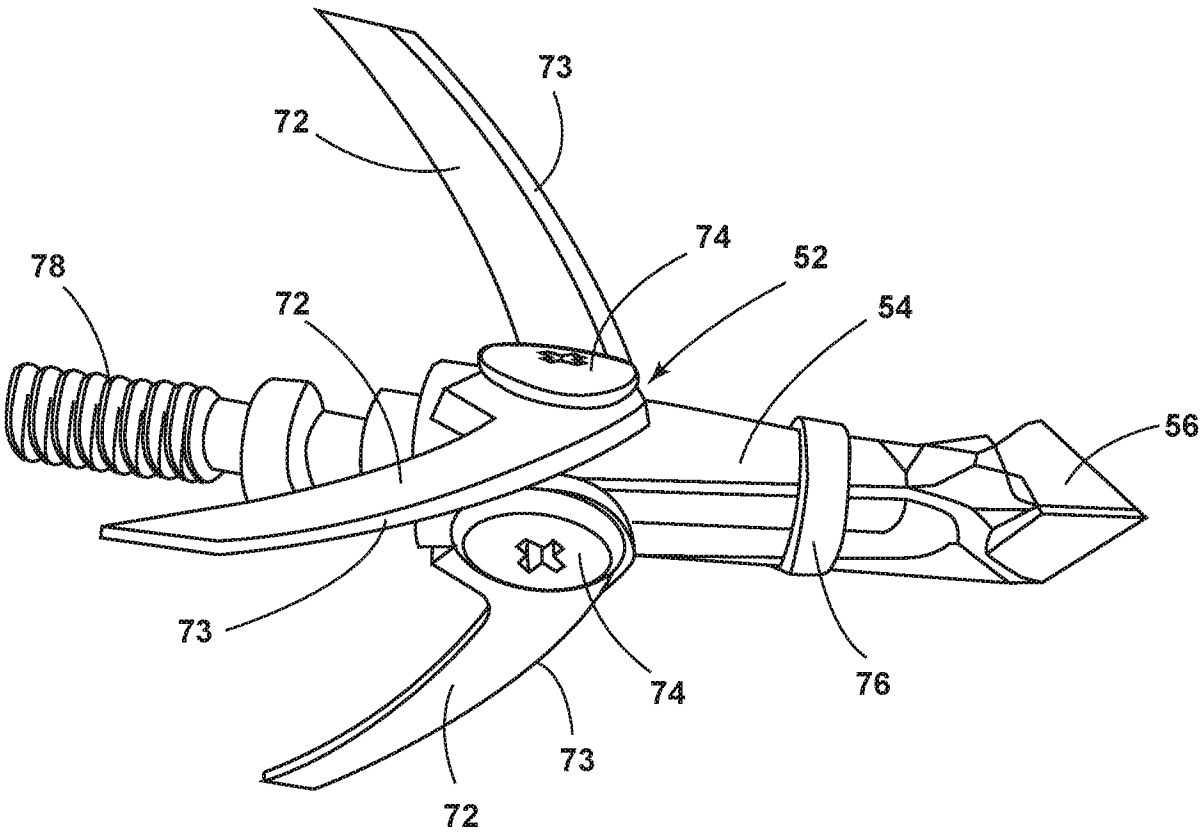
FIG. 7 is a side perspective view an expandable broadhead according to another embodiment of the present invention.
Figure 8:
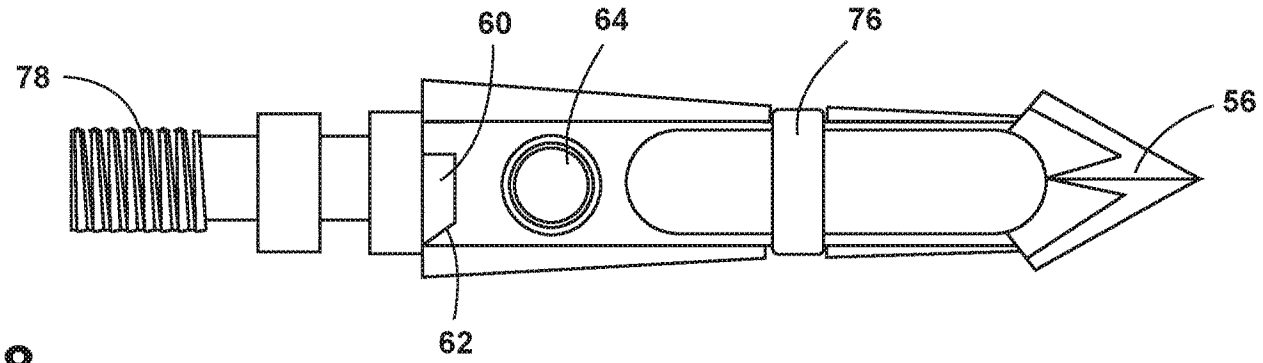
FIG. 8 is the ferrule of the broadhead shown in FIG. 7.
Figure 9:
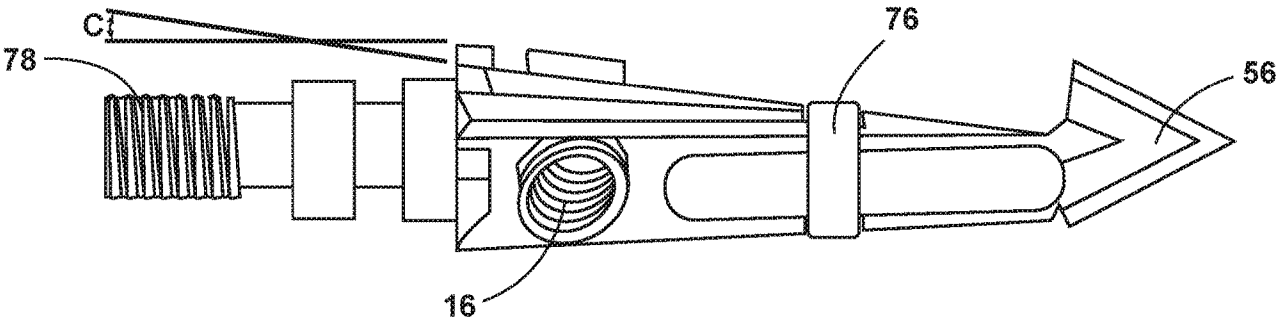
FIG. 9 is a rotated view of the ferrule shown in FIG. 8.

Another embodiment of the invention is shown in FIGS. 7-12. The broadhead 52 shown in FIG. 7 is with the blade 72 in a fully deployed position. The expandable broadhead 52 includes a ferrule 54 that has a forward portion 57 terminating in tip 56. The ferrule 54 also includes a rearward portion 59 that terminates in a threaded end 78 that connects to the shaft of an arrow or a bolt. A medial portion 61 is located between the forward portion 57 and the rearward portion 59. A plurality of posts 64 are located in the medial portion 61. The posts 64 are angled. As illustrated in FIGS. 8 and 9, the ferrule 54 includes a plurality of posts 64 that include drilled and tapped openings 66. The posts 64 are angled such that the blades 72 will contact the band 76 that is located in the band slot 58 of the ferrule 54 when the blades 72 are in a closed position.

Figure 10:
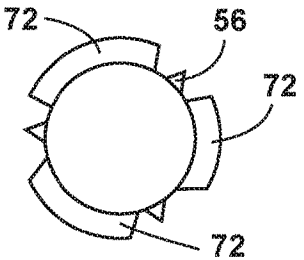
FIG. 10 is a bottom perspective view of the rearward end of the broadhead shown in FIG. 7 in the closed position.
Figure 11:
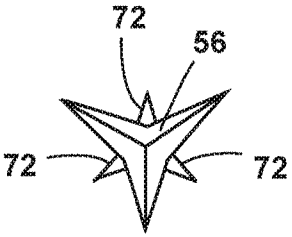
FIG. 11 is a top perspective view of the forward tip end of the broadhead shown in FIGS. 7 and 10 in the closed position.

As illustrated in FIGS. 10 and 11, when the blades 72 are in a closed position, the blades 72 are closely held in contact with the band 76. The angle D of the posts 64 is in the range of 2 to 10 degrees, and more preferably approximately 4 degrees. Angle D is approximately the same angle as the taper C on the body of the ferrule 54.

Figure 12:
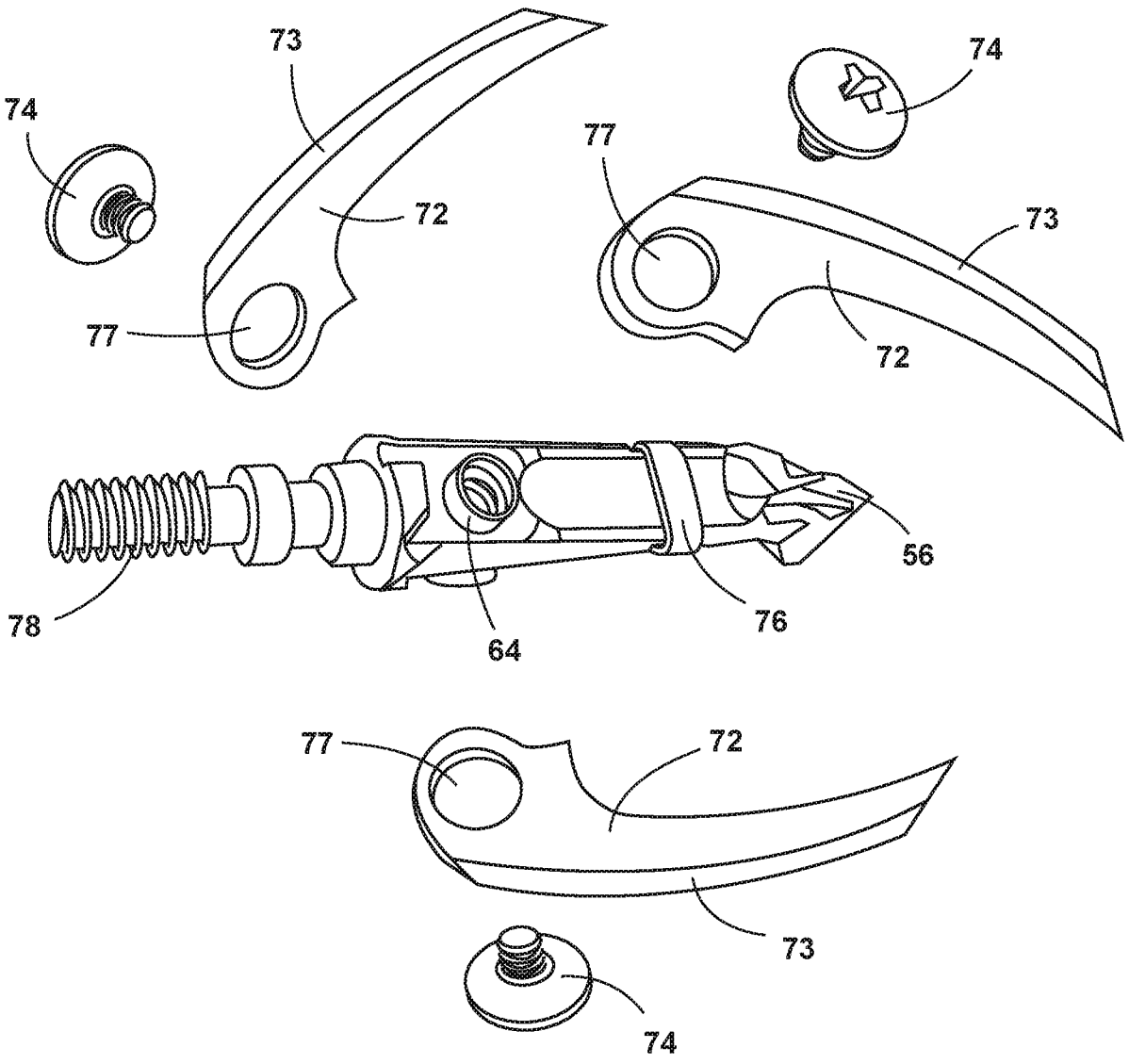
FIG. 12 is an assembly drawing of the components of the broadhead shown in FIG. 7.

As illustrated in FIG. 12, fasteners 74 are received through fastener openings 77 on the blades 72 to secure the blade 72 to the ferrule 64. When the blades 72 are positioned in a closed position, each blade 72 will contact a forward blade stop 70. The blades 72 also include a portion 63 that contacts the angle 62 on the rearward blade stops 60 when the blades 72 are in a fully deployed position.

The blades 22, 72 are shown with a curved, sharpened edge 23, 73. However, the blades 22, 72 can have other geometric shapes since the blades 22, 72 are positioned on the exterior of the ferrule 4, 54. Thus, the blades 22, 72 can include teeth, angle changes, blunt portions, and other external features on both the sharpened edge and the unsharpened edge. In the illustrated embodiments, the blades 22, 72 rotate in a generally clockwise manner. Considering the fasteners 24, 74 at a 6 o'clock position, and the forward blade stops 20, 70 at the 12 o'clock position, the tips of the blades 22, 72 are positioned at an approximate 1 or 2 o'clock position (when the broadhead 2, 52 is closed) and are thus pre-loaded to rotate clockwise. Moreover, in this arrangement, the entire sharpened edge 23, 73 rotates to a cutting position upon deployment of the blades 22, 72.

In the foregoing description, it will be readily appreciated by those skilled in the art that modifications may be made to the invention without departing from the concepts disclosed herein. Such modifications are to be considered as included in the following claims, unless these claims by their language expressly state otherwise.

It will be understood by one having ordinary skill in the art that construction of the present disclosure and other components is not limited to any specific material. Other exemplary embodiments of the disclosure disclosed herein may be formed from a wide variety of materials, unless described otherwise herein.

For purposes of this disclosure, the term "coupled" or "operably coupled" (in all of its forms, couple, coupling, coupled, etc.) generally means the joining of two components (electrical or mechanical) directly or indirectly to one another. Such joining may be stationary in nature or movable in nature. Such joining may be achieved with the two components (electrical or mechanical) and any additional intermediate members being integrally formed as a single unitary body with one another or with the two components. Such joining may be permanent in nature or may be removable or releasable in nature unless otherwise stated.

For purposes of this disclosure, the term "connected" or "operably connected" (in all of its forms, connect, connecting, connected, etc.) generally means that one component functions with respect to another component, even if there are other components located between the first and second component, and the term "operable" defines a functional relationship between components.

It is also important to note that the construction and arrangement of the elements of the present disclosure as shown in the exemplary embodiments is illustrative only. Although only a few embodiments of the present innovations have been described in detail in this disclosure, those skilled in the art who review this disclosure will readily appreciate that, unless otherwise described, many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements shown as multiple parts may be integrally formed, the operation of the interfaces may be reversed or otherwise varied, the length or width of the structures and/or members or connector or other elements of the system may be varied, the nature or number of adjustment positions provided between the elements may be varied. It should be noted that the elements and/or assemblies of the system may be constructed from any of a wide variety of materials that provide sufficient strength or durability, in any of a wide variety of colors, textures, and combinations. Accordingly, all such modifications are intended to be included within the scope of the present innovations. Other substitutions, modifications, changes, and omissions may be made in the design, operating positions, and arrangement of the desired and other exemplary embodiments without departing from the spirit of the present innovations.

It will be understood that any described processes or steps within described processes may be combined with other disclosed processes or steps to form structures within the scope of the present disclosure. The exemplary structures and processes disclosed herein are for illustrative purposes and are not to be construed as limiting.

It is also to be understood that variations and modifications can be made on the aforementioned structures and methods without departing from the concepts of the present invention, and further it is to be understood that such concepts are intended to be covered by the following claims unless these claims by their language expressly state otherwise.

The invention claimed is:

1. A broadhead comprising:

a ferrule having a forward pointed end, and a rearward end that couples to a shaft, said ferrule comprising:

a plurality of raised threaded posts located on an exterior surface of said ferrule between said forward pointed end and said rearward end, said threaded posts having an angled top surface that tapers toward said forward pointed end of said ferrule;

a plurality of raised rearward blade stops located on an exterior surface of said ferrule rearward of said plurality of angled threaded posts;

a plurality of raised forward blade stops having at least one side surface and at least one top surface located forward of said plurality of raised threaded posts on the forward pointed end;

at least one frictional retention member located on the exterior surface of said ferrule between said plurality of raised rearward blade stops and said plurality of raised forward blade stops;

a plurality of blades having a sharpened edge, wherein each of said blades is coupled to a raised threaded post by a fastener, such that each blade has an edge that contacts said at least one side surface of a forward blade stop and an inner surface that contacts said at least one frictional retention member when the broadhead is in a closed position and an edge that contacts a rearward blade stop when the broadhead is in a fully deployed position.

2. The broadhead of claim 1, wherein said ferrule has a slot located rearward of said plurality of raised forward blade stops.

3. The broadhead of claim 2, wherein said at least one frictional retention member is a polymeric band located in said slot located rearward of said plurality of raised forward blade stops.

4. The broadhead of claim 3, wherein said ferrule is tapered downward from said plurality of said threaded posts to said forward pointed end.

5. The broadhead of claim 1, wherein a top surface of said raised threaded posts permits said inner surface of said plurality of blades to contact said at least one frictional retention member.

6. The broadhead of claim 5, wherein said angle is in the range of 2 degrees to 10 degrees.

7. The broadhead of claim 6, wherein said angle is approximately 4 degrees.

8. The broadhead of claim 7, wherein said taper of said ferrule is approximately 4 degrees.

9. The broadhead of claim 1, wherein said rearward blade stops have an angled surface that contacts angled surfaces on rearward ends of said plurality of blades when said broadhead is in a fully deployed position.

10. An expandable broadhead, comprising:

a ferrule having a forward pointed end and a rearward end, comprising:

a plurality of raised threaded posts located on an exterior of said ferrule between said forward pointed end and said rearward end;

a plurality of raised rearward blade stops located on an exterior of said ferrule rearward of said plurality of angled threaded posts;

a plurality of forward blade stops located forward of said plurality of raised threaded posts on the forward pointed end;

at least one frictional retention member located on the exterior of said ferrule between said plurality of raised forward blade stops and said plurality of forward blade stops;

a plurality of blades having an inner side facing said ferrule that contacts said at least one frictional retention member when the blade is in a closed position, an outer side facing away from said ferrule, a sharpened edge that includes a portion that contacts said forward blade stop when the blade is in a closed position, an unsharpened edge, a surface that contacts said rearward blade stop when the blade is in a deployed position, and a fastener opening; and a plurality of fasteners inserted through said fastener openings to couple said plurality of blades to said plurality of raised threaded posts.

11. The expandable broadhead of claim 10, wherein said at least one frictional retention member is a band.

12. The expandable broadhead of claim 10, wherein said plurality of threaded posts are drilled and tapped at an approximately 4 degree angle toward the forward pointed end of the ferrule, said angle defined with respect to a longitudinal centerline of the ferrule.

13. The expandable broadhead of claim 10, wherein said plurality of blades include at least one curved surface.

14. The expandable broadhead of claim 11, wherein said band is located in a slot in said ferrule.

15. The expandable broadhead of claim 10, wherein said ferrule includes a recessed portion between said plurality of threaded posts and said plurality of forward blade stops which are at least partially covered by said inner surface of said plurality of blades when said expandable broadhead is in a closed position.

16. A broadhead ferrule comprising:

a forward portion terminating in a pointed tip;

a rearward portion having a rearward most end that couples to a shaft;

a medial portion located between said forward portion and said rearward portion;

a plurality of raised threaded posts located on an exterior surface of said ferrule on said medial portion;

a plurality of raised rearward blade stops located on an exterior surface of said ferrule rearward of said plurality of angled threaded posts;

a plurality of forward blade stops located on said forward portion; and at least one raised frictional retention member located on the exterior surface of said ferrule between said plurality of raised threaded posts and said plurality of forward blade stops, configured to frictionally engage an inner surface of a blade when the blade is in a closed position on the ferrule.

17. The broadhead ferrule of claim 16, including two threaded posts.

18. The broadhead ferrule of claim 16, including three threaded posts.

19. The broadhead ferrule of claim 16, wherein said plurality of threaded posts are drilled and tapped at an approximately 2-degree to 10-degree angle toward the forward pointed end of the ferrule, said angle defined with respect to a longitudinal centerline of the ferrule.

20. The broadhead ferrule of claim 19, wherein said angle is approximately 4 degrees.

* * * * *